US009964322B2

(12) United States Patent
Arensmeier

(10) Patent No.: US 9,964,322 B2
(45) Date of Patent: May 8, 2018

(54) CONTROLLER SET POINT ADJUSTMENT BASED ON OUTDOOR TEMPERATURE

(71) Applicant: Emerson Electric Co., St. Louis, MO (US)

(72) Inventor: Jeffrey N. Arensmeier, Fenton, MO (US)

(73) Assignee: EMERSON ELECTRIC CO., St. Louis, MO (US)

( * ) Notice: Subject to any disclaimer, the term of this patent is extended or adjusted under 35 U.S.C. 154(b) by 167 days.

(21) Appl. No.: 14/678,169

(22) Filed: Apr. 3, 2015

(65) Prior Publication Data

US 2016/0290672 A1 Oct. 6, 2016

Related U.S. Application Data

(60) Provisional application No. 62/141,759, filed on Apr. 1, 2015.

(51) Int. Cl.
*F24F 11/00* (2018.01)

(52) U.S. Cl.
CPC ..... *F24F 11/006* (2013.01); *F24F 11/30* (2018.01); *F24F 11/62* (2018.01); *F24F 2110/12* (2018.01)

(58) Field of Classification Search
None
See application file for complete search history.

(56) References Cited

U.S. PATENT DOCUMENTS

| | | | | |
|---|---|---|---|---|
| 4,341,345 | A | 7/1982 | Hammer et al. | |
| 4,657,179 | A * | 4/1987 | Aggers | G05D 23/1905 236/51 |
| 5,115,967 | A | 5/1992 | Wedekind | |
| 5,197,668 | A | 3/1993 | Ratz et al. | |
| 5,555,927 | A | 9/1996 | Shah | |
| 6,622,926 | B1 | 9/2003 | Sartain et al. | |
| 7,775,454 | B2 | 8/2010 | Mueller et al. | |
| 8,010,237 | B2 | 8/2011 | Cheung et al. | |
| 8,177,139 | B2 | 5/2012 | Mueller et al. | |
| 8,280,556 | B2 | 10/2012 | Besore et al. | |
| 9,423,146 | B2 * | 8/2016 | Bruce | F24F 11/0086 |
| 2012/0226388 | A1 | 9/2012 | Evans et al. | |
| 2014/0156088 | A1 * | 6/2014 | Li | G05B 15/02 700/278 |

* cited by examiner

*Primary Examiner* — Ryan Jarrett
(74) *Attorney, Agent, or Firm* — Harness, Dickey & Pierce, P.L.C.

(57) ABSTRACT

Disclosed are exemplary embodiments of apparatus and methods for adjusting controller set points based on outdoor temperature. In an exemplary embodiment, a climate control system controller for providing climate control in a structure includes a processor and memory configured to obtain adjusted heating and cooling set point values determined by combining adjustment amounts with heating and cooling set points set for the climate control system. The adjustment amounts are determined in accordance with deviations of sensed outdoor ambient temperature (OAT) values from an intermediate OAT value predefined in a range of OAT values. The controller, in response to sensed outdoor temperatures in the range of OAT values, controls heating and cooling in the structure in accordance with the adjusted heating and cooling set point values.

18 Claims, 7 Drawing Sheets

CONTROLLER SET POINT ADJUSTMENT BASED ON OUTDOOR TEMPERATURE

CROSS-REFERENCE TO RELATED APPLICATION

This application claims the benefit of U.S. Provisional Application No. 62/141,759, filed on Apr. 1, 2015. The entire disclosure of the above application is incorporated herein by reference.

FIELD

The present disclosure generally relates to thermostats and other controllers, and more particularly (but not exclusively) to adjusting a controller set point based on outdoor temperature.

BACKGROUND

This section provides background information related to the present disclosure which is not necessarily prior art.

Homeowners and other building occupants often seek to improve indoor comfort and/or save energy costs by making adjustments to indoor climate control systems. A building occupant may check a thermostat to determine the indoor temperature and then may manually adjust one or more indoor temperature set points on the thermostat. Such an adjustment may remain in effect, e.g., until the next manual adjustment.

SUMMARY

This section provides a general summary of the disclosure, and is not a comprehensive disclosure of its full scope or all of its features.

According to various aspects, exemplary embodiments are disclosed of apparatus and methods for adjusting controller set points based on outdoor temperature. In an exemplary embodiment, a climate control system controller for providing climate control in a structure generally includes a processor and memory configured to obtain adjusted heating and cooling set point values determined by combining adjustment amounts with heating and cooling set points set for the climate control system. The adjustment amounts are determined in accordance with deviations of sensed outdoor ambient temperature (OAT) values from an intermediate OAT value predefined in a range of OAT values. The controller is configured to, in response to sensed outdoor temperatures in the range of OAT values, control heating and cooling in the structure in accordance with the adjusted heating and cooling set point values.

In another example embodiment, an apparatus for providing climate control in a structure generally includes a controller configured to control heating and cooling in the structure. A processor and memory are configured to receive a sensed outdoor ambient temperature (OAT) value, and determine an adjustment amount based on the sensed OAT value and in accordance with an adjustment function defining adjustment amounts for adjusting heating and cooling set points based on deviations of sensed OAT from an intermediate temperature value in a range of OAT values. The processor and memory are further configured to combine the determined adjustment amount with the value of a heating or cooling set point set for the structure, to obtain an adjusted set point value. The controller is further configured to control the heating or cooling in accordance with the adjusted set point value.

Also disclosed are methods that generally include a method performed by an apparatus for providing climate control in a structure. The method includes adjusting a heating or cooling set point value for control of temperature inside a structure. The adjusting is performed in accordance with an adjustment function defining adjustment amounts by which to adjust heating and cooling set point values in accordance with deviation of sensed outdoor ambient temperature (OAT) from an intermediate temperature value between a plurality of OAT values associated with heating and a plurality of OAT values associated with cooling. In response to sensed outdoor ambient temperature (OAT), heating or cooling inside the structure is controlled using the adjusted heating or cooling set point.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

The inventor hereof has recognized that as outdoor ambient temperatures change, e.g., with the time of day and/or with the seasons, homeowners and other building users often strive to save energy consumption costs by manually setting and resetting thermostat set points to cost-saving levels. Additionally, utilities and utility providers frequently encourage homeowners and other users to change temperature set points, e.g., in order to reduce total energy usage in a geographic area during peak energy usage periods. The inventor also has observed that it can be uncomfortable for a user to enter and leave a building when the indoor temperature is substantially different from the outdoor temperature.

Accordingly, the inventor has developed and discloses herein exemplary embodiments of apparatus and methods for performing climate control in a structure, e.g., by adjusting the values of heating and cooling set points previously set, e.g., on a thermostat or other climate control system controller. For example, a climate control system thermostat may adjust a heating or cooling set point value based on current outdoor ambient temperature (OAT). In one example embodiment, a climate control system controller such as a thermostat receives sensed OAT values, e.g., from an OAT sensor local to a structure or from a server or other computer remote from the structure.

In various embodiments, in determining whether to issue a call for heating or cooling, a processor, e.g., of a climate control system controller determines a difference between the previously set heating or cooling set point and a sensed OAT value received by the controller. Based on the difference, the processor adjusts the value of the heating or cooling set point in accordance with an adjustment function. Such a function may be user-selectable and defines heating and cooling set point adjustment amounts based on deviations of sensed outdoor ambient temperature, e.g., from an intermediate temperature value predefined in a range of OAT values. The range of OAT values includes, e.g., a plurality of OAT values associated with heating and a plurality of OAT values associated with cooling. The controller provides temperature control inside the structure in accordance with the adjusted heating or cooling set point value.

Figure 1:
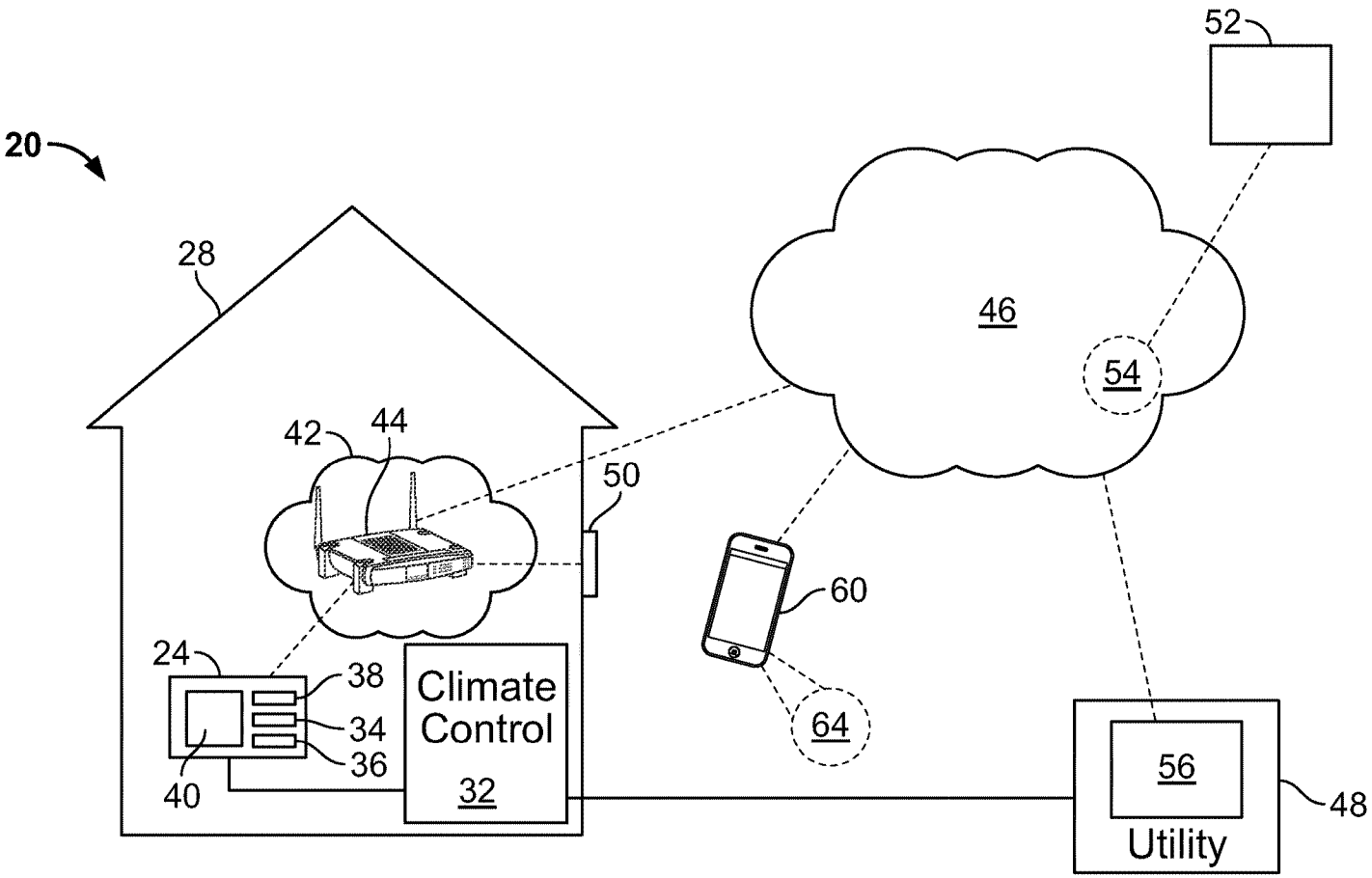
FIG. 1 is a diagram of an apparatus for providing climate control inside a structure in accordance with one example embodiment of the disclosure.

With reference to the figures, FIG. 1 is a diagram of an exemplary apparatus 20 for providing climate control inside a structure, the apparatus 20 embodying one or more aspects of the present disclosure. A thermostat 24 or other controller is provided for use in a structure 28, e.g., a residence, to control a climate control system 32 of the structure 28. The thermostat 24 includes a processor 34, memory 36, a wireless interface 38, and a user interface 40, e.g., a display, press keys, etc. The thermostat 24 is configured to communicate wirelessly in a user network 42 via a user network access point, e.g., a home network router 44 that provides wireless access to a wide-area network 46 such as the Internet. A utility or utility provider 48 may provide, e.g., gas and/or electricity to the climate control system 32. In the present example embodiment, the climate control system includes a temperature sensor 50 located outside the structure 28. The temperature sensor 50 senses outdoor ambient temperature (OAT) and periodically transmits a signal indicative of the current OAT to the thermostat 24. The current OAT signals may be transmitted wirelessly or through a wired connection between the temperature sensor 50 and the thermostat 24.

As shown in FIG. 1, the apparatus 20 includes at least one computer 52, e.g., one or more servers, routers, personal computers, combinations of the foregoing, various combinations of processors and memory, etc. It should be noted that many different device configurations could be used to provide the capabilities described herein. In one example implementation, the computer(s) 52 are configured to provide energy information and energy management services through a web portal 54 available via the wide-area network 46. The web portal 54 may make such information and services available, e.g., to thermostat owners, installers, and other users. The utility or utility provider 48 may also include one or more computers 56, e.g., one or more servers, routers, etc. whereby the utility or utility provider 48 may access the wide area network 46.

In various embodiments, an energy management service provider may make the web portal 54 available to users, e.g., on or through server(s) on the computer(s) 52. Additionally or alternatively, a user may employ a mobile application as further described below, to access home energy management services and/or to remotely control the thermostat 24. A computer 52 may be included, e.g., in a "cloud" server site in which various analyses may be performed to provide real-time energy management services. In some embodiments an installer or user of the thermostat 24 creates an energy management account for the user on the portal 54, and the user may enter preferences for energy management through the portal 54. For example, the user may enter desired heating and/or cooling temperature set points for the thermostat 24, e.g., for various periods of occupancy, non-occupancy, sleep, etc.

In various embodiments, a user may remotely access the thermostat 24, e.g., from a user communication device 60. A user communication device 60 may include (without limitation) a mobile device such as a cellular or mobile phone, a smart phone such as a Blackberry®, an Android® device, an I-Phone® or I-Pad®, that can communicate using wireless communication, including but not limited to Wi-Fi, 802.11-based, WiMAX, Bluetooth, Zigbee, 3G, 4G, subscriber-based wireless, PCS, EDGE, and/or other wireless communication means, or substantially any combination thereof. A user device 60 may include a capability for determining and providing geographic locations, e.g., Global Positioning Service (GPS) and/or other location service. A user communication device 60 may have, or have access to, a software application 64 configured to perform various functions in accordance with various implementations of the disclosure. In one example implementation, the software application 64 is loaded onto the communication device 60 by the computer(s) 52. Implementations also are possible in which the user communication device 60 uses and/or communicates through web services and/or a web browser to implement the application 64.

In various embodiments, a thermostat or other controller may use an adjusted value of a set point instead of the predefined set point to control the heating or cooling. Such adjustment(s) may be made based on currently sensed outdoor ambient temperature (OAT) and in accordance with an adjustment function applicable to both the predefined heating and cooling system set points. In some example embodiments, the thermostat 24 receives sensed OAT values, e.g., from the outdoor temperature sensor 50. To determine whether to issue a call for heat, the thermostat 24 compares indoor temperature to an adjusted heating set point value instead of to the predefined heating set point value. The thermostat 24 adjusts, e.g., reduces, the value of the heating set point as OAT grows colder and deviates from an intermediate outdoor temperature value, e.g., an outdoor temperature value between OAT values associated by the thermostat 24 with heating and OAT values associated by the thermostat 24 with cooling. Similarly, the thermostat 24 determines whether to issue a call for cooling by comparing indoor temperature to an adjusted cooling set point value instead of a predefined cooling set point value. The thermostat 24 adjusts, e.g., increases, the value of the cooling set point for the climate control system 32 as OAT grows warmer and deviates from the intermediate temperature value.

In various embodiments, as a difference increases between current outdoor temperature and the current indoor temperature set point, the value of an adjustment or offset to the current indoor temperature set point also increases. Adjustment functions can be user-selected and/or shaped in accordance with various user objectives, including but not limited to that of reducing energy consumption and saving energy costs.

Figure 2A:
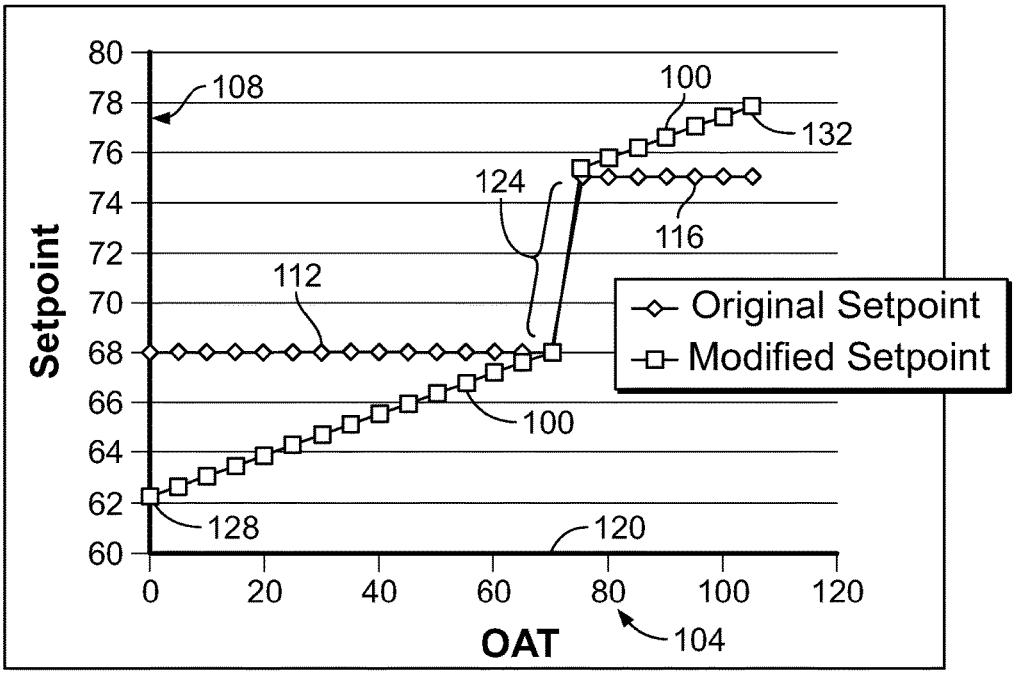
FIG. 2A is a graph illustrating an adjustment function in accordance with one example embodiment of the disclosure.

Various adjustment functions can provide various levels of energy savings in terms, e.g., of reduction in energy use. In one example embodiment, an adjustment function may be user-selected from a predefined set of functions, including, e.g., linear, power, and exponential functions as shown in FIGS. 2A-5B. One exemplary linear adjustment function is indicated by reference number 100 in FIG. 2A and is shown relative to an example OAT range 104 and an example climate control system set point range 108. The linear adjustment function 100 defines adjustment amounts for adjusting a heating set point 112 and a cooling set point 116 in accordance with deviations of OAT from an intermediate OAT value 120. In the present example embodiment, the heating set point 112 is set at 68 degrees F. and the cooling set point 116 is set at 75 degrees F. The heating and cooling set points 112 and 116 thus are separated from each other by temperature values 124. In some embodiments, a climate control system would provide neither heating nor cooling inside a structure when such intermediate temperatures 124 are sensed. In the present example embodiment, the linear adjustment function 100 is of the following example form:

$$\text{adjustedSP}=\text{SP}+(\text{OAT}-k1)\cdot k2$$

where SP represents a current set point and adjustedSP represents the current set point value adjusted by an adjustment amount (OAT−k1)·k2. In the adjustment amount, OAT represents outdoor ambient temperature and k1 and k2 are constants. In the example linear adjustment function 100, the constant k1 is set to 70, and the constant k2 is set to 0.0855. As shown in FIG. 2A, If heating and cooling set points were predefined to be the same temperature, the adjustment function 100 would appear as a straight line intersecting a horizontal set point line at the intermediate OAT value 120, which is about 70 degrees F. in the present example embodiment. In various embodiments, a user such as an occupant of the structure may not only predefine heating and cooling set points but also may define and/or select an adjustment function. End points 128 and 132 and/or the intermediate temperature value 120 of the OAT range 104 also may be user-selectable.

Figure 2B:
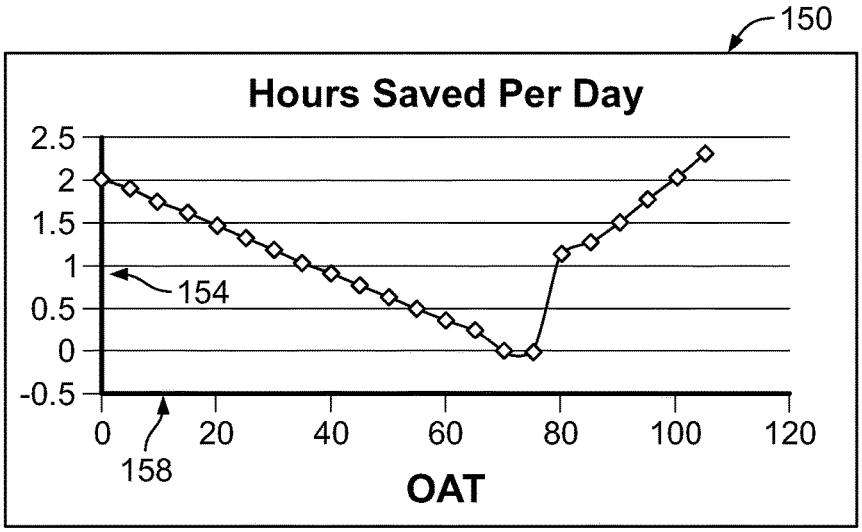
FIG. 2B is a graph illustrating hours saved per day by the adjustment function of FIG. 2A in accordance with one example embodiment of the disclosure.

Using the adjustment function 100 to adjust set point values as shown in FIG. 2A, and using the adjusted values to control heating and/or cooling, can result in energy savings compared to using the unadjusted set points 112 and 116 to control temperature. For example, as shown in FIG. 2B, a graph 150 indicates estimated hours 154 of energy consumption saved per day using the adjustment function 100 relative to OAT 158, instead of using the unadjusted set points 112 and 116

Figure 3A:
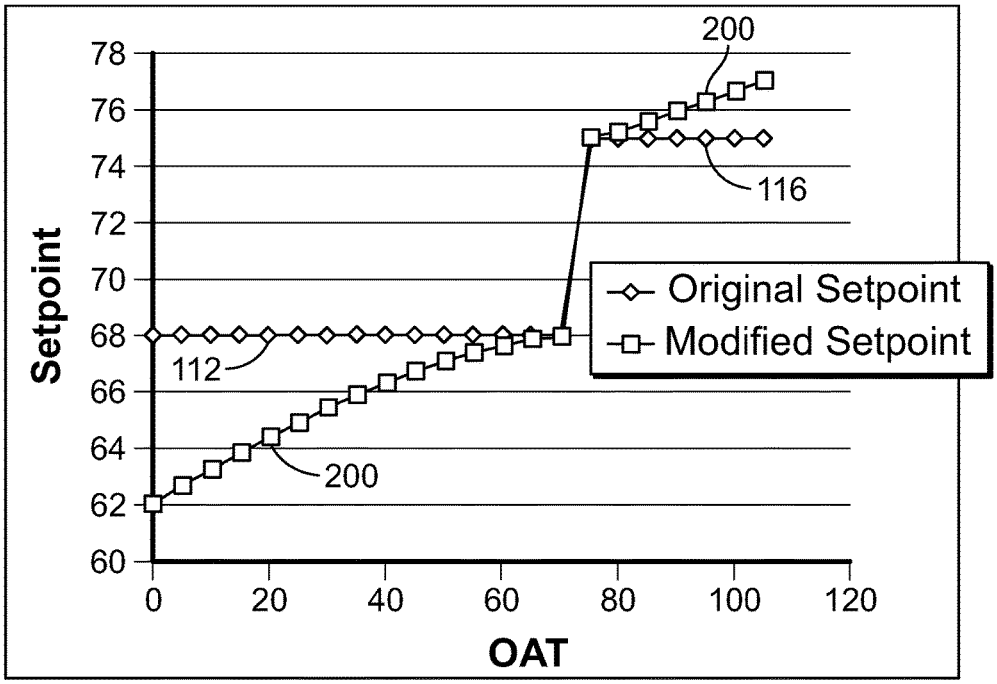
FIG. 3A is a graph illustrating an adjustment function in accordance with one example embodiment of the disclosure.
Figure 3B:
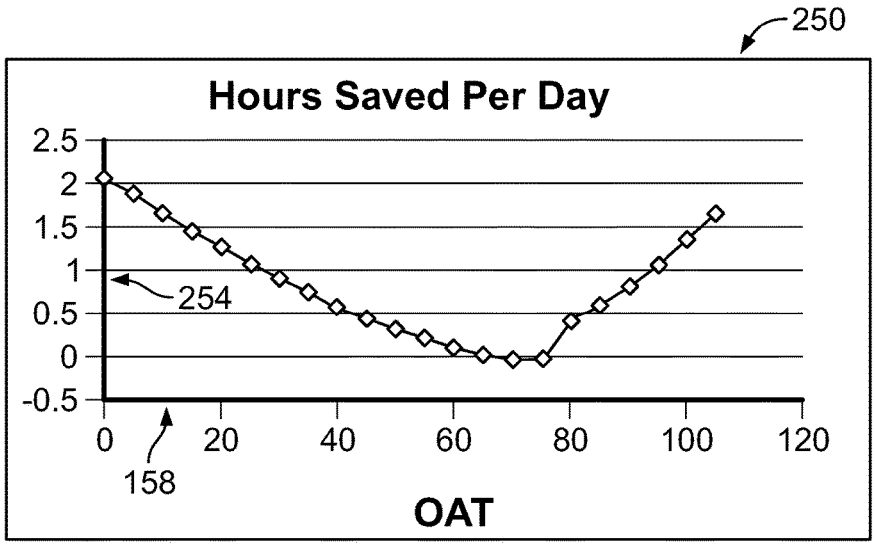
FIG. 3B is a graph illustrating hours saved per day by the adjustment function of FIG. 3A in accordance with one example embodiment of the disclosure.

One example power adjustment function is indicated by reference number 200 in FIG. 3A and is shown relative to the same example OAT range 104 and set points 112 and 116 as shown in FIG. 2A. In the present example embodiment, the power adjustment function 200 is of the following example form:

$$\text{adjustedSP}=\text{SP}+((\text{ABS}(\text{OAT}-k1))\hat{}\,k2)\cdot k3\cdot(\text{sign}(\text{OAT}-k1)$$

where SP represents a current set point and adjustedSP represents the current set point value adjusted by an adjustment amount ((ABS(OAT−k1))^k2)·k3·(sign(OAT−k1). In the adjustment amount, OAT represents outdoor ambient temperature and k1, k2 and k3 are constants. In the example power adjustment function 200, the constant k1 is set to 70, the constant k2 is set to 1.5, and the constant k3 is set to 0.0102. As shown in FIG. 3B, a graph 250 indicates estimated hours 254 of energy consumption saved per day using the adjustment function 200 relative to OAT 158, instead of using the unadjusted set points 112 and 116.

Figure 4A:
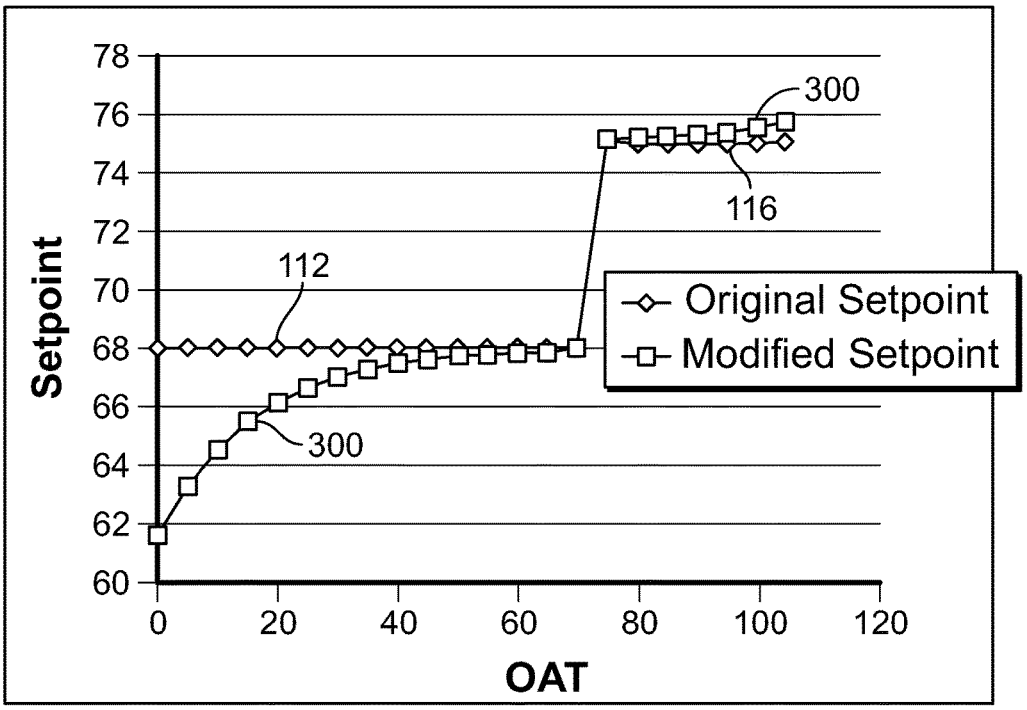
FIG. 4A is a graph illustrating an adjustment function in accordance with one example embodiment of the disclosure.
Figure 4B:
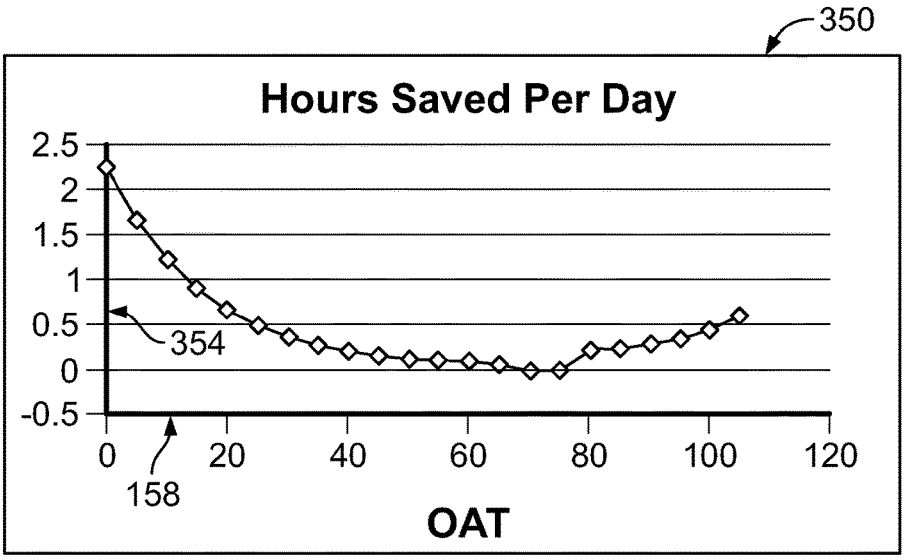
FIG. 4B is a graph illustrating hours saved per day by the adjustment function of FIG. 4A in accordance with one example embodiment of the disclosure.

One example exponential adjustment function is indicated by reference number 300 in FIG. 4A and is shown relative to the OAT range 104 and set points 112 and 116 of FIG. 2A. In the present example embodiment, the exponential adjustment function 300 is of the following example form:

$$\text{adjustedSP}=\text{SP}+(\exp(\text{ABS}(\text{OAT}-k1)/k2)\cdot k3\cdot(\text{sign}(\text{OAT}-k1)$$

where SP represents a current set point and adjustedSP represents the current set point value adjusted by an adjustment amount (exp(ABS(OAT−k1)/k2)·k3·(sign(OAT−k1). In the adjustment amount, OAT represents outdoor ambient temperature and k1, k2 and k3 are constants. In the example exponential adjustment function 300, the constant k1 is set to 70, the constant k2 is set to 16, and the constant k3 is set to 0.075. As shown in FIG. 4B, a graph 350 indicates estimated hours 354 of energy consumption saved per day using the adjustment function 300 relative to OAT 158, instead of using the unadjusted set points 112 and 116.

Figure 5A:
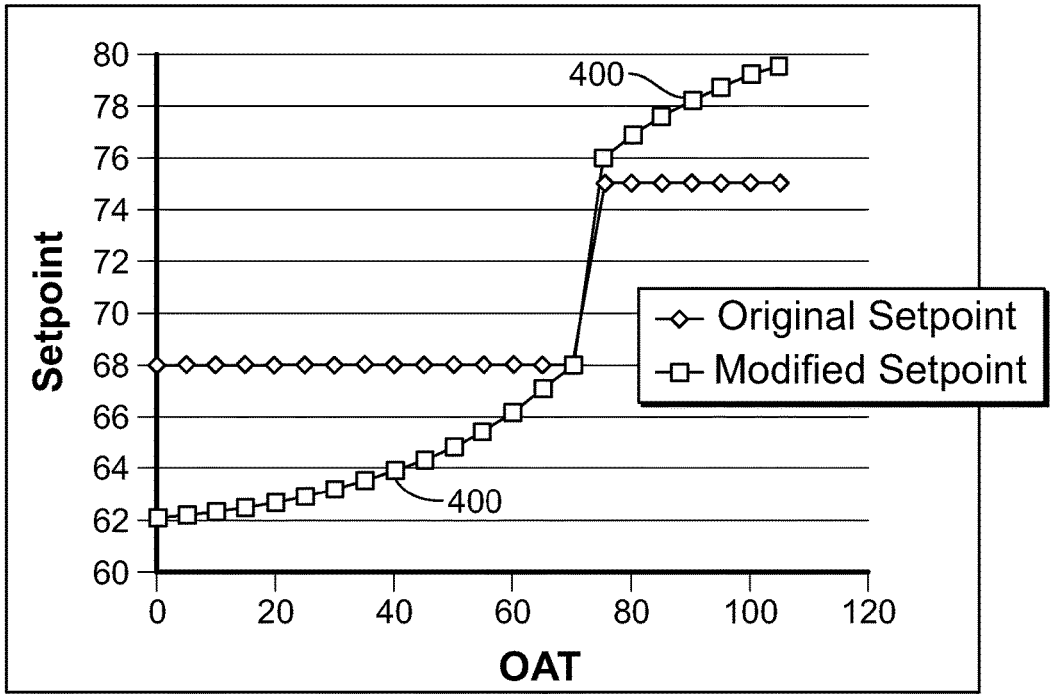
FIG. 5A is a graph illustrating an adjustment function in accordance with one example embodiment of the disclosure.
Figure 5B:
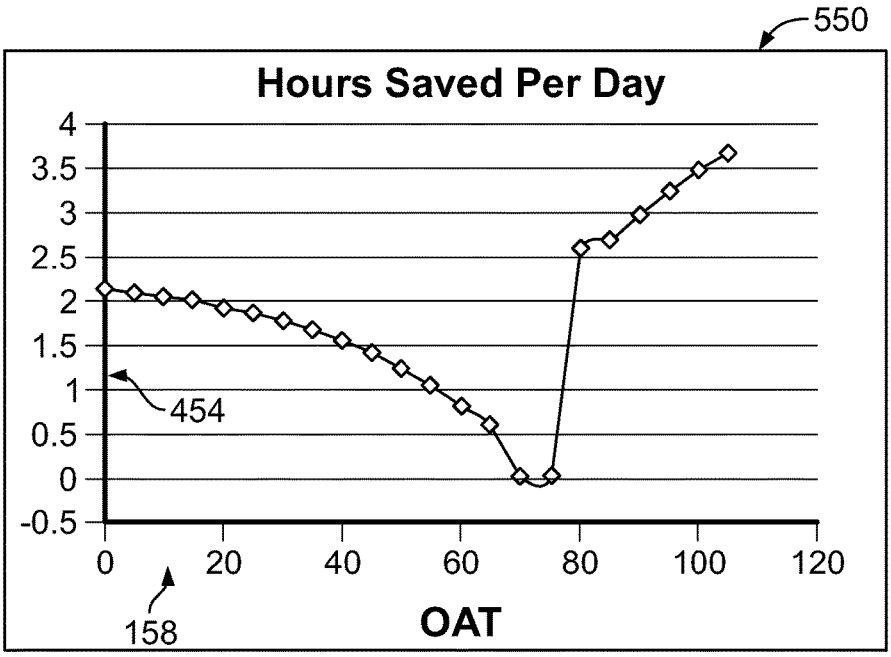
FIG. 5B is a graph illustrating hours saved per day by the adjustment function of FIG. 5A in accordance with one example embodiment of the disclosure.

Another exemplary exponential adjustment function is indicated by reference number 400 in FIG. 5A and is shown relative to the OAT range 104 and set points 112 and 116 of FIG. 2A. In the present example embodiment, the exponential adjustment function 400 is of the following example form:

$$\text{adjustedSP}=\text{SP}+1-(\exp(\text{ABS}(\text{OAT}-k1)/k2)\cdot k3\cdot(\text{sign}(\text{OAT}-k1)$$

where SP represents a current set point and adjustedSP represents the current set point value adjusted by an adjustment amount (1−(exp(ABS(OAT−k1)/k2)·k3·(sign(OAT−k1)). In the adjustment amount, OAT represents outdoor ambient temperature and k1, k2 and k3 are constants. In the example exponential adjustment function 400, the constant k1 is set to 70, the constant k2 is set to 30, and the constant k3 is set to 6.64. As shown in FIG. 5B, a graph 550 indicates estimated hours 454 of energy consumption saved per day using the adjustment function 400 relative to OAT 158, instead of using the unadjusted set points 112 and 116.

For comparative purposes, the example adjustment functions shown in FIGS. 2A, 3A, 4A and 5A are configured to have approximately the same set point value adjustment (minus about 62 degrees F.) at 0 degrees OAT, and estimated hours saved as shown in FIGS. 2B, 3B, 4B and 5B are estimated based on nominal equipment sizing.

A user may configure an adjustment function so as to provide discrete set point adjustments desired by the user. Adjustment amounts defined by various adjustment functions may be preset and/or user-adjusted, e.g., via parameter input(s) on a thermostat or other climate control system controller, via a web page and/or mobile or other application interface, etc. Additionally or alternatively, in various embodiments a user may define an individual adjustment function via graphical input, e.g., using "equalizer" sliders, by dragging and dropping curve points, etc. on a graphical user interface such as a mobile device screen, laptop screen, etc. In various embodiments, parameter limits and/or adjustment limits may be included to prevent user error in selecting parameters and/or adjustment amounts.

Figure 6:
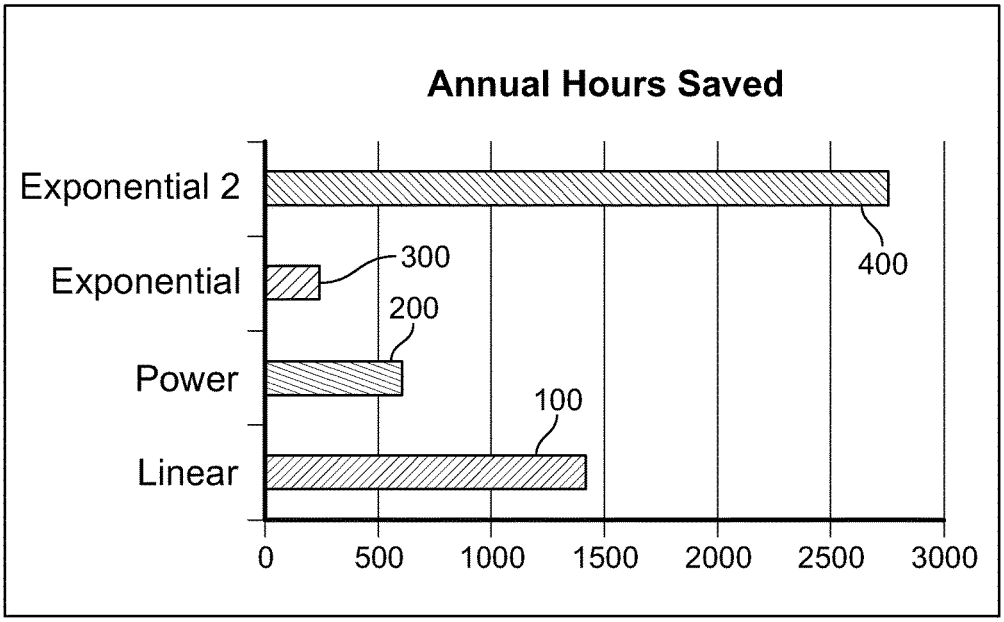
FIG. 6 is a graph illustrating annual hours saved by the adjustment functions of FIGS. 2A, 3A, 4A and 5A in accordance with one example embodiment of the disclosure.

A comparison of annual hours estimated by the inventor to be saved using the functions 100, 200, 300 and 400 is shown in FIG. 6. Estimated savings are projected over a 5-year period of Midwestern United States weather, using data from the National Weather Service, and where each model is adjusted to yield an adjusted heating set point value of 62 degrees F. at 0 degrees OAT.

Figure 7A:
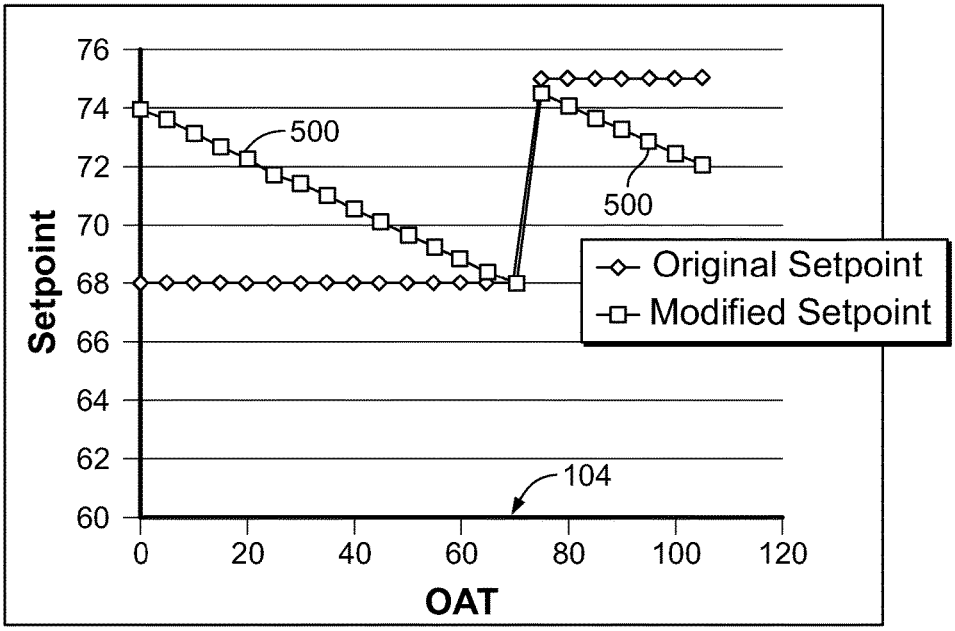
FIG. 7A is a graph illustrating an adjustment function in accordance with one example embodiment of the disclosure.
Figure 7B:
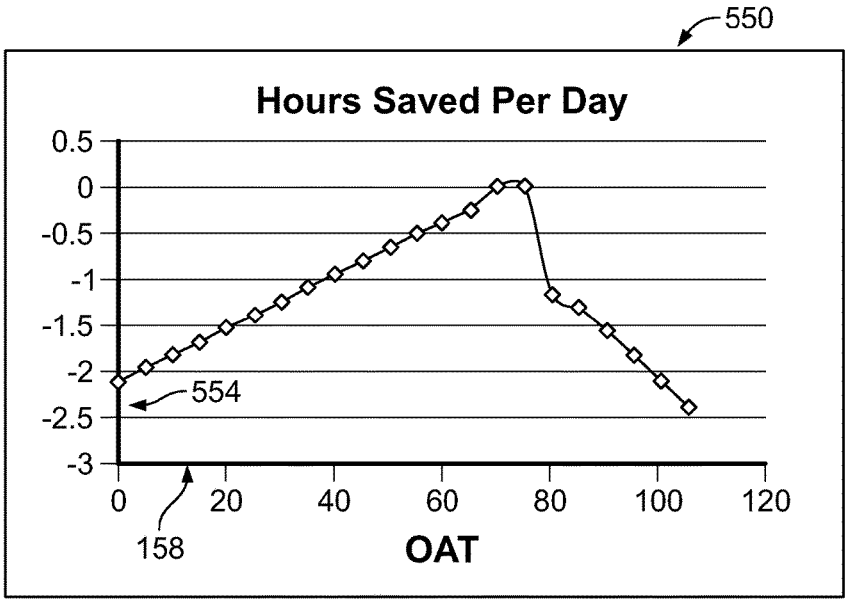
FIG. 7B is a graph illustrating hours saved per day by the adjustment function of FIG. 7A in accordance with one example embodiment of the disclosure.
Figure 8:
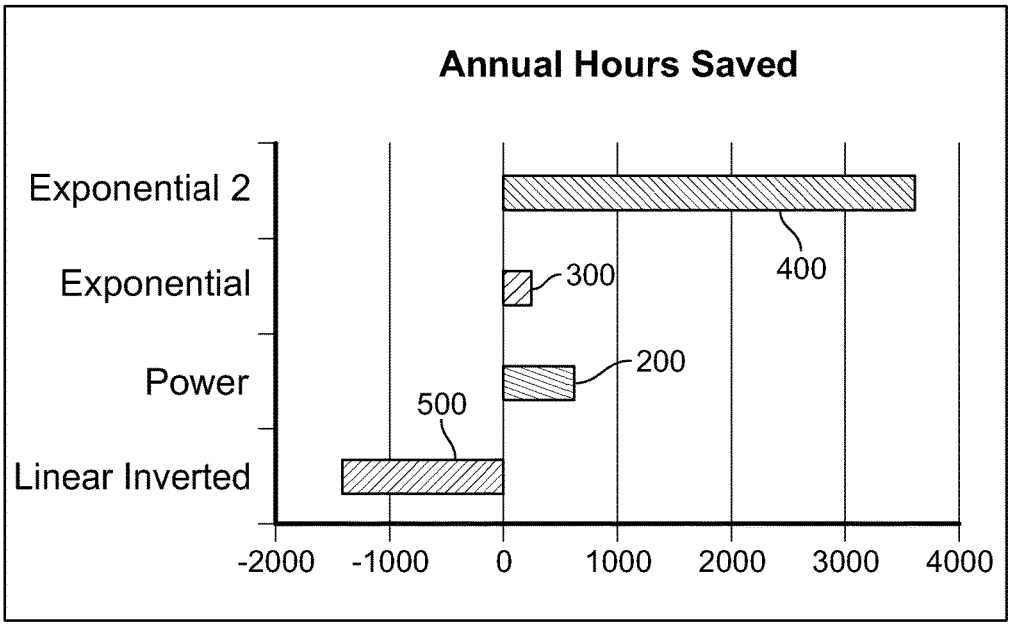
FIG. 8 is a graph illustrating annual hours saved by the adjustment functions of FIGS. 3A, 4A, 5A and 7A in accordance with one example embodiment of the disclosure.

Reducing energy consumption and saving energy costs are not the only possible objectives that might be pursued through the use of adjustment functions to adjust set points. Other or additional adjustment functions may be used, e.g., by a user wishing to increase temperatures as OAT drops and to lower temperatures as OAT increases, without regard, e.g., to energy consumption. One such adjustment function is indicated by reference number 500 in FIG. 7A and is shown relative to the OAT range 104 and set points 112 and 116 of FIG. 2A. The function 500 is an inverted version of the linear function 100 of FIG. 2. As shown in FIG. 7B, a graph 550 indicates estimated hours 554 of energy consumption "saved" per day (mostly if not all below zero) using the adjustment function 500 relative to OAT 158, instead of using the unadjusted set points 112 and 116. A comparison of annual hours estimated by the inventor to be saved using the functions 200, 300, 400 and 500 is shown in FIG. 8.

Various adjustment functions may be selected and/or created. An adjustment function can include, for example, one type of function as to heating and another type of function as to cooling. In one example embodiment, a user may create an adjustment function by combining a linear adjustment function for heating with an exponential adjustment function for cooling, etc.

It should be noted that adjustment functions could be applied in various ways by various users and/or third parties in relation to climate control systems. In some embodiments, and referring again to FIG. 1, an occupant of the structure 28 and/or the utility or utility provider 48 may invoke the capability to apply an adjustment function as to the climate control system 32. An occupant may do so locally or remotely, e.g., by using a switch on the thermostat 24 and/or by using the application 64 via the mobile user device 60. The utility or utility provider 48 may do so remotely, e.g., to reduce energy usage during a time period in which energy demand is high. Additionally or alternatively, in some implementations the utility or utility provider 48 may select an adjustment function for application during such periods.

In some embodiments a user, e.g., an occupant of the structure 28, may select or create an adjustment function and send it to a remote server to store for subsequent use. The server may be, e.g., on a computer 52 serving an energy management account for the user, or on a computer 56 of a utility or utility provider 48. Additionally or alternatively, a server may make a menu of adjustment functions available, from which the user may select an adjustment function to be stored, e.g., on the server for later use. To determine whether to call for heat (or for cooling, as the case may be) the thermostat 24 may send its predefined heating set point (or cooling set point) to the remote server serving the user's energy management account. The server may obtain the OAT for the thermostat geographic location from a temperature source based, e.g., on a zip code or other location information available from the user account on the server. The server may apply the stored adjustment function to the OAT and the user's heating (or cooling) set point value to obtain an adjustment amount by which to adjust the set point value. The server may send the adjusted set point value to the thermostat 24, which uses it to control heating (or cooling, as the case may be.)

Additionally or alternatively, the thermostat 24 may wirelessly and periodically request and/or receive from the computer(s) 52 OAT values local to the location of the thermostat 24. The thermostat 24 may apply an adjustment function preselected, e.g., by the user from a menu on the computer(s) 52, to the OAT and set point value to determine an adjusted set point value. The thermostat 24 then compares indoor temperature to the adjusted set point value and performs climate control based on the comparison.

In some other example embodiments, some or all calculations for obtaining set point adjustment amounts are cloud-based, e.g., performed at one or more computers 52, based, e.g., on OAT values obtained at the computer(s) 52 for the geographic location of the thermostat 24. Such adjustment amounts may be transmitted, e.g., pushed, e.g., by a server of the computer(s) 52 to the thermostat 24, which applies the adjustment amounts to offset set point values stored at or available to the thermostat 24. In various example embodiments, a server of the computer(s) 52 may have previously stored set point values for the thermostat 24, and calculates and applies adjustment amounts to the stored set point values. The server may transmit, e.g., push, the adjusted set point values to the thermostat 24 for use in providing heating and/or cooling. In some embodiments, if communication is lost between the thermostat 24 and a transmitting server such that, e.g., the thermostat 24 does not receive set point adjustment amounts or adjusted set point values, the thermostat 24 may, e.g., revert to performing a base control program local to the thermostat. The thermostat 24 thus may use, e.g., selected heating and/or cooling set points stored at the thermostat 24, instead of adjustment amounts and/or adjusted set point values, to perform heating and/or cooling.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally," "about," and "substantially," may be used herein to mean within manufacturing tolerances. Or, for example, the term "about" as used herein when modifying a quantity of an ingredient or reactant of the invention or employed refers to variation in the numerical quantity that can happen through typical measuring and handling procedures used, for example, when making concentrates or solutions in the real world through inadvertent error in these procedures; through differences in the manufacture, source, or purity of the ingredients employed to make the compositions or carry out the methods; and the like. The term "about" also encompasses amounts that differ due to different equilibrium conditions for a composition resulting from a particular initial mixture. Whether or not modified by the term "about," the claims include equivalents to the quantities.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A thermostat for providing climate control in a premises, the thermostat comprising:

a processor and memory configured to:

obtain adjusted heating and cooling set point values determined by combining adjustment amounts with heating and cooling set points set for a climate control system local to the premises and controlled by the thermostat, the adjustment amounts determined in accordance with (a) an adjustment function input by and/or selected by a user of the premises, where the adjustment function does not necessarily take energy consumption into account, and (b) deviations of sensed outdoor ambient temperature (OAT) values from an intermediate OAT value predefined in a range of OAT values;

whereby the thermostat is configured to, in response to sensed outdoor temperatures in the range of OAT values, control heating and cooling in the premises in accordance with the adjusted heating and cooling set point values.

2. The thermostat of claim 1, wherein the adjustment function is input by the user via graphical input predefining the adjustment amounts.

3. The thermostat of claim 1, wherein the adjustment function includes one or more of the following: a linear function, a power function, an exponential function, and an inverted function.

4. The thermostat of claim 1, further configured to receive the sensed outdoor temperatures from one or more of the following: an outdoor temperature sensor in communication with the thermostat, a sensor remote from the climate control system, and a computer remote from the climate control system.

5. The thermostat of claim 1, further configured to make available a plurality of adjustment functions for selection therefrom by one or more of the following: the user, a utility, and a utility provider.

6. An apparatus for providing climate control in a premises, the apparatus comprising:

a thermostat configured to control heating and cooling in the premises; and a processor and memory configured to:

receive a sensed outdoor ambient temperature (OAT) value;

determine an adjustment amount based on the sensed OAT value and in accordance with an adjustment function input by and/or selected by a user of the premises and defining adjustment amounts for adjusting heating and cooling set points based on deviations of sensed OAT from an intermediate temperature value in a range of OAT values, the adjustment function not necessarily taking energy consumption into account; and combine the determined adjustment amount with the value of a heating or cooling set point set for the premises, to obtain an adjusted set point value for use by the thermostat;

the thermostat further configured to control the heating or cooling in accordance with the adjusted set point value.

7. The apparatus of claim 6, wherein the intermediate temperature value is between a plurality of OAT values associated with heating and a plurality of OAT values associated with cooling.

8. The apparatus of claim 6, wherein the processor and memory are comprised by one or more of the following: a controller, the thermostat, a computer remote from the premises, and a mobile user device.

9. The apparatus of claim 6, wherein the adjustment function includes one or more of the following: a linear function, a power function, an exponential function, and an inverted function.

10. The apparatus of claim 6, wherein the adjustment function is one of a plurality of adjustment functions for selection therefrom by one or more of the following: the user of the premises, a utility, and a utility provider.

11. The apparatus of claim 6, configured to receive the sensed outdoor ambient temperature (OAT) value from one or more of the following: an outdoor temperature sensor in communication with the thermostat, a sensor remote from the thermostat, and a computer remote from the thermostat.

12. A method performed by an apparatus for providing climate control in a premises, the method comprising:

adjusting a heating or cooling set point value for control of temperature inside a premises, the adjusting performed in accordance with an adjustment function input by and/or selected by a user of the premises and defining adjustment amounts by which to adjust heating and cooling set point values in accordance with deviation of sensed outdoor ambient temperature (OAT) from an intermediate temperature value between a plurality of OAT values associated with heating and a plurality of OAT values associated with cooling, the adjustment function not necessarily taking energy consumption into account; and in response to sensed outdoor ambient temperature (OAT), a thermostat of the apparatus controlling heating or cooling inside the premises using the adjusted heating or cooling set point.

13. The method of claim 12, further comprising sensing the OAT, the sensing performed by one or more of the following: an outdoor temperature sensor in communication with the thermostat, a sensor remote from the thermostat, and a computer remote from the premises.

14. The method of claim 12, further comprising making the adjustment function available as one of a plurality of adjustment functions available for selection therefrom by one or more of the following: the user, a utility, and a utility provider.

15. The method of claim 12, further comprising receiving, from the user, input for configuring the adjustment function, the receiving performed via a user interface.

16. The method of claim 12, wherein the adjusting is performed at least in part by one or more computers remote from the premises.

17. The method of claim 12, further comprising:

determining, at the premises, that an adjusted heating or cooling set point is not available for use in performing the controlling; and in response to the determining, the thermostat controlling the heating or cooling using a set point available locally at the premises.

18. The method of claim 17, wherein the determining is performed by the thermostat.

* * * * *